United States Patent [19]

Tullis et al.

[11] 3,974,898

[45] Aug. 17, 1976

[54] CONVERTIBLE SUITCASE

[76] Inventors: Kay Jeanne Tullis, 191A Throckmorton, Mill Valley; Robert Stanley Krolick, P. O. Box 3557, Daly City, both of Calif. 94941

[22] Filed: May 23, 1975

[21] Appl. No.: 580,476

[52] U.S. Cl. ..... 190/3; 312/111; 190/60

[51] Int. Cl.[2] ..... A47B 61/06

[58] Field of Search ..... 190/3, 6, 7, 18 R, 21, 190/44, 52, 60; 312/111, 333, 107

[56] References Cited

UNITED STATES PATENTS

| | | | |
|---|---|---|---|
| 1,092,651 | 4/1914 | Jordan | 312/333 |
| 2,565,969 | 8/1951 | Judson | 312/107 X |
| 2,891,639 | 6/1959 | Betts | 312/107 X |
| 3,028,207 | 4/1962 | Darnell | 312/111 |
| 3,032,381 | 5/1962 | Boro | 312/111 |
| 3,506,321 | 4/1970 | Hampel | 312/107 |

*Primary Examiner*—Donald F. Norton
*Attorney, Agent, or Firm*—Schapp and Hatch

[57] ABSTRACT

A hand-portable suitcase unit formed by a drawer and a slip-case cover, with a retaining lock which retains the drawer within the cover so that the unit may be carried as luggage by a combination carrying handle and drawer pull attached to the drawer front. Interlocking bead members are provided on the upper and lower surfaces of the slip-cases so that they may be stacked with the drawers horizontal to form a chest-of-drawers, and a cooperating latching device is shown on the rear face of the slip-case for releasably locking the covers together in the stack.

2 Claims, 5 Drawing Figures

CONVERTIBLE SUITCASE

BACKGROUND OF THE INVENTION

This invention relates to a CONVERTIBLE SUITCASE, and, more particularly, to a piece of furniture of the chest-of-drawers type which may be disassembled into a plurality of hand-portable suitcase units.

Prior art in this field has included many designs for modular or expandable furniture. One example is the expandable covered bookcase unit, with glass front doors which lift in the style of an overhead garage door. Such furniture is designed with the intent to allow purchase of individual units or modules as needed, without having an unfinished look to the assembled units. Furniture of this type is not designed for hand-portability of the units, and particularly not with the compactness and security of closure necessary for suitcase use. Furthermore, such units generally lack the necessary quickness and convenience of disassembly for luggage use.

Steamer trunks and portable wardrobes are known, with individual drawers and compartments housed in a common, portable enclosure, but such trunks and wardrobes are not designed to allow individual separated use of the drawers as luggage pieces on their own. Moreover, few steamer trunks possess sufficient simplicity or elegance of design to be termed an article of home or office furniture. They are usually constructed with a rigid outer enclosure for the drawers and compartments, so that they could not fairly be termed expandable.

SUMMARY OF THE INVENTION

The suitcase unit of the present invention is designed for convertible use both as a piece of hand-carried luggage and, with a group of similar units, as a piece of furniture of the chest-of-drawers type. The convertible suitcase allows secure fastening of the envelope or slip-cover over the drawer, and is compactly designed for easy portability inthe manner of a small suitcase or attache case. The individual suitcase units can be securely coupled together for practical use as a chest-of-drawers, and yet they also can be conveniently and rapidly uncoupled for separated use. The handle of the drawer is designed for use both as a drawer pull and a carrying handle to facilitate the dual use of the unit.

The particular means for coupling the units together for furniture purposes are unobtrusive, so that the unit in use as a suitcase resembles luggage, rather than disassembled furniture. The inconspicuous nature of the coupling mechanisms used also helps disguise the separability of the units when they are assembled as furniture.

Accordingly, it is a principal object of the present invention to provide a convertible suitcase unit of the character described useable both as a drawer and enclosure in an article of furniture and as an independent piece of hand-carried luggage.

It is a further principal object of the present invention to provide an article of furniture of the chest-of-drawers type formed from a plurality of interlocking separable units.

Yet another object of the present invention is to provide a suitcase unit of the character described having inconspicuous and yet effective, simple interlocking means for coupling a plurality of such units together.

A still further object of the present invention is to provide a suitcase unit of the character described which may be kept packed for traveling purposes until needed, while serving meantime as a drawer for the same contents.

Still another object of the present invention is to provide a combination suitcase and chest-of-drawers unit in which the interconnecting means are effectively and esthetically disguised.

Further objects and advantages of the present invention will become apparent as the specification progresses, and the new and useful features thereof will be fully defined in the claims attached hereto.

BRIEF DESCRIPTION OF THE DRAWINGS

The preferred form of the present invention is illustrated in the accompanying drawings, forming part of this specification, in which.

Figure 1:
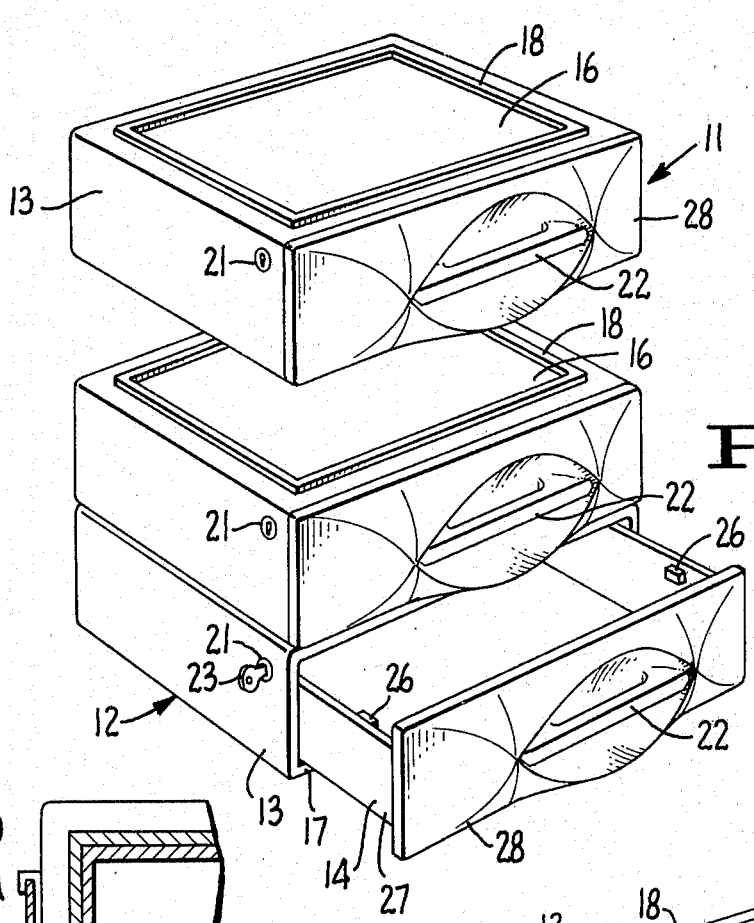
FIG. 1 is a perspective view, partially exploded, of the convertible chest-of-drawers unit of the present invention.
Figure 4:
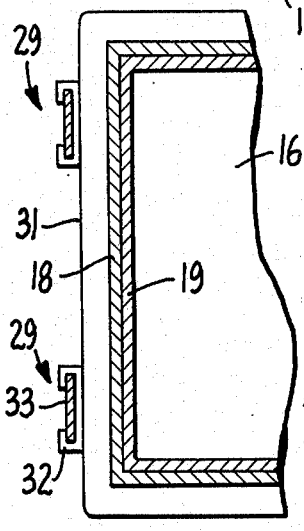
FIG. 4 is a fragmentary cross-sectional view taken approximately along the plane of lines 4—4 of FIG. 3.

While only the preferred form of the present invention has been shown here, it should be understood that various changes or modifications may be made within the scope of the claims attached hereto without departing from the spirit of the invention.

DESCRIPTION OF THE PREFERRED EMBODIMENT

Referring to the drawings in detail, it may be seen that the combination suitcase and chest-of-drawers unit 11 of the present invention is adapted for optional assembly into an article of furniture resembling a chest-of-drawers, generally indicated at 12, and includes an outer envelope member 13 and an inner drawer member 14 slidably mounted in the envelope member 13.

Figure 3:
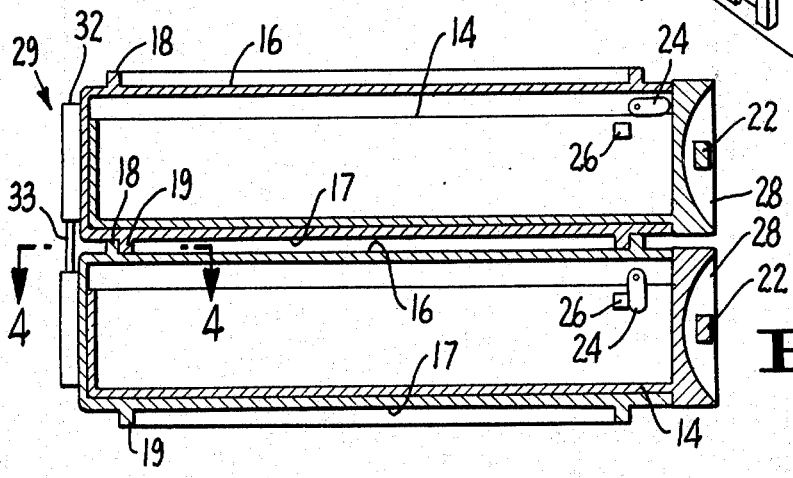
FIG. 3 is a cross-sectional view taken approximately along the plane of lines 3—3 of FIG. 2.
Figure 5:
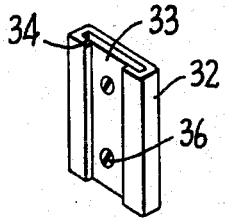
FIG. 5 is a perspective view of one of the latch members.

The envelope member 13 has two generally planar parallel sides 16, 17, with interlockable members 18, 19, respectively, upstanding from the planar parallel sides 16, 17. The interlockable members 18, 19 are dimensioned so that they engage the corresponding members 18, 19 on the confronting face of another suitcase unit 11 brought into juxtaposition with the first suitcase unit 11, as shown in FIG. 3.

The drawer member 14 is formed with a handle portion 22 on the front of the drawer 14, and a lock mechanism 21 is carried by the envelope member 13, to selectively hold the drawer 14 closed within the envelope 13. With the lock mechanism 21 engaged to retain the envelope 13 around the drawer 14, the individual unit 11 may be carried safely by its handle portion 22 in the fashion of a suitcase or attache case.

The lock mechanism 21 may be any one of a number of suitable designs such as those commonly employed for small cabinets or luggage, and is provided with a key 23. The lock mechanism 21 shown here extends through the sidewall of the envelope member 13 and operates a locking tab 24, which pivots in a plane generally parallel to the side of the envelope 13 into and out of engagement with a stop member 26 mounted on a sidewall 27 of the drawer 14. When the locking tab 24 is in the position shown in FIG. 3, it bears against the stop member 26 to retain the drawer member 14 in the envelope 13. When unlocked, the tab 24 is rotated approximately a quarter turn counterclockwise as viewed in FIG. 3 to disengage the stop 26 and permit the withdrawal of the drawer 14.

The envelope member 13 is a hollow rectangular parallelepiped body with one open side. The planar parallel sides 16, 17 form the two largest sides of the body. The open side of the body is closed off by the drawer front portion 28 of the drawer 14 when the drawer is fully inserted into the envelope member 13. The handle portion 22 is attached to the drawer front 28 and formed to serve both as a drawer pull and a carrying handle for the individual unit 11.

The interlockable members 18, 19 are formed as bead portions arranged in a rectangle on the outer surfaces of the respective sides 16, 17 of the envelope member 13. One of the rectangles has an open center and is slightly larger in its inner dimensions than the outer dimensions of the other rectangle, so that the second rectangle may be nested within the first rectangle when individual units 11 are brought into confronting relationship.

As shown here, the rectangle formed by the interlockable bead members 18 is the larger of the two, and is formed on the top planar side 16 of the envelope member 13. The top rectangle 18 of one unit 11 thus receives in nesting fashion the bottom rectangle 19 of another unit 11 placed atop the first individual unit 11, as shown in cross section in FIG. 3. The low height of the beads 18, 19 and the congruence of their rectangular shape with that of the entire unit 11 make the interlocking mechanism quite unobtrusive and acceptable as an esthetic element of the design.

Figure 2:
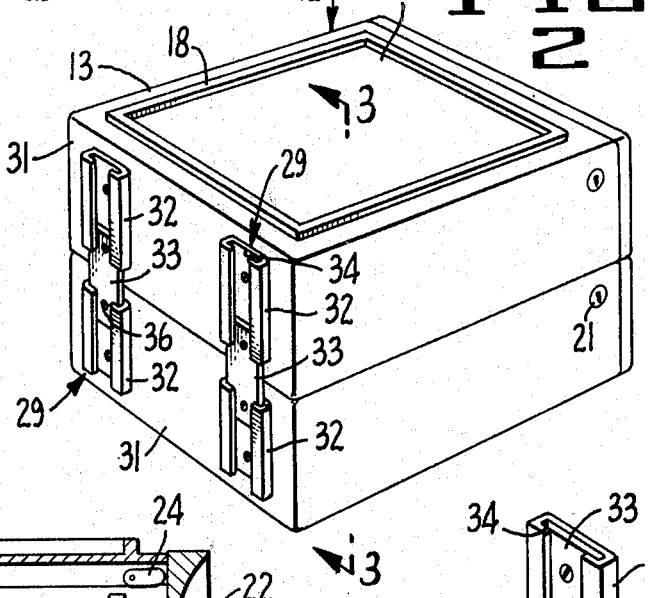
FIG. 2 is a back perspective view corresponding to FIG. 1 with the units rotated a quarter turn about a vertical axis.

Cooperating with the interlocking members 18, 19 is a retaining latch member, generally indicated at 29, borne on the rearward side 31 of the envelope member 13. The latch member 29 includes a channel member 32 attached to the envelope 13 and formed with a channel 34 passing through it, oriented generally perpendicular to the sides 16, 17 and generally parallel to the rearward side 31. A bolt member 33 is slidably mounted in the channel 34, and may be selectively slid within the channel 34 into partial engagement with a corresponding channel member 32 on an envelope member 13 placed adjacent to the first envelope member 13, as shown in FIG. 2.

The bolt 33 remains partially engaged with the first channel member 32, so that the engagement of the bolt with the second channel member 32 on an adjacent unit 11 impedes relative movement between the two adjacent envelope members 13. The bolt 33 is secured in either extended or retracted position by screws 36 which pass through the bolt 33 and are engaged with a threaded aperture in the channel member 32. Although the latch 29 would function with only one screw 36 in each bolt, two are provided here so that the bolt 33 may be firmly secured by the screw to each of the adjacent co-linear channel members 32 with which it is engaged when in its extended position.

When the bolt 33 is retracted fully into one of the channel members 32, as when the unit 11 is used individually as luggage, the screws 36 may be engaged with both apertures in the same channel member 32 to secure the bolt in that retracted position. In the separated, individual use of the units 11 as luggage, the channel members 32 also serve as protective feet when the individual suitcase unit 11 is stood vertically with the rearward side 31 down. Since one less bolt 33 is required than the number of units 11 to be stacked, the bolt 33 may also be completely removed from the channel 34 in one of the units 11 in the stack.

The cooperation between the latch members 29 and the interlockable members 18, 19 results from the ability of the latch members 29 to hold the interlocking beads 18, 19 together, that is, in engagement with each other, and to resist tipping and jarring motions to which the bead members 18, 19 are vulnerable. On the other hand, the bead members 18, 19 resist the twisting movement which might otherwise bend or damage the latch members 29. Together, the two mechanisms 29 and 18, 19 result in an unusual degree of stability for the coupled-together units 11, functioning as a single piece of furniture.

From the foregoing, it may be seen that a convertible unit has been provided which functions both as an individual carried piece of luggage and as an interlocking unit in a modular, expandable piece of furniture of the chest-of-drawers type. The interlocking means are simple, secure, and effectively disguised, and yet readily releasable, so that a drawer may be kept packed with items suitable for traveling while acting as part of the piece of furniture, and then be uncoupled for easy use as luggage.

What is claimed is:

1. A combination suitcase and chest-of-drawers, comprising a plurality of stackable and hand-portable suitcase units, each suitcase unit comprising an outer envelope member, an inner drawer member slidably mounted in said envelope member, and said envelope member having two generally planar parallel sides thereto, the outer surfaces of said sides having interlockable bead portions thereon formed to upstand therefrom and dimensioned so as to engage the corresponding interlockable portions on the confronting face of a second suitcase unit brought into juxtaposition therewith and to impede relative movement of the two suitcase units with respect to each other in the plane of said planar parallel sides, each of said envelope members further comprising a retaining latch mechanism borne on the rearward side of said envelope member, said latch mechanism comprising a channel member fixed to said envelope member and formed with a channel therein oriented generally perpendicular to said planar parallel sides and generally parallel to said rearward side, and a bolt member slidably mounted in said channel member and selectively partially engageable with a corresponding channel member on an envelope member placed adjacent thereto while retaining partial engagement with said first-named channel member, to restrain relative movement between said envelope members.

2. A combination suitcase and chest-of-drawers as described in claim 1 and wherein said envelope member is formed as a hollow rectangular body having one open side, said planar parallel sides forming the two largest sides thereof, said envelope member having a lock mechanism mounted therein and selectively engageable with said drawer member to retain said drawer member in the closed position, said drawer member further comprising a drawer front positioned and dimensioned to close off the open side of said envelope member when said drawer member is fully inserted into said envelope member, and a handle portion formed on said drawer front to serve as both a drawer pull and a suitcase handle, whereby the suitcase unit may be carried by said handle portion with said envelope member retained around said drawer member, said bead portions on one of said planar parallel sides being formed into an open rectangle and said bead portions on the other of said planar parallel sides being formed into a second rectangle having outer dimensions slightly less than the inner dimensions of said open rectangle, whereby one of said rectangles on a first suitcase unit may be made to nest inside the other of said rectangles on a confronting face of a second suitcase unit brought adjacent thereto.

* * * * *